US005596942A

United States Patent [19]

Kojima et al.

[11] Patent Number: 5,596,942

[45] Date of Patent: Jan. 28, 1997

[54] FEEDING SUPPORT FOR A SEWN PRODUCT

[75] Inventors: Hiroshi Kojima, Utsunomiya; Nobuo Baba, Kaminokawa-machi, both of Japan

[73] Assignee: The Singer Company N.V., Curaco, Netherlands

[21] Appl. No.: 285,684

[22] Filed: Aug. 4, 1994

[30] Foreign Application Priority Data

Sep. 21, 1993 [JP] Japan ..... 5-256281

[51] Int. Cl.[6] ..... D05B 35/00

[52] U.S. Cl. ..... 112/260; 112/304

[58] Field of Search ..... 112/260, 303, 112/304, 306, 311, 314, 320, 322; 271/130, 148, 158, 160, 162, 164, 260

[56] References Cited

U.S. PATENT DOCUMENTS

| | | | |
|---|---|---|---|
| 685,812 | 10/1900 | Smyth | 271/148 X |
| 2,500,731 | 3/1950 | Zeir | 112/260 |
| 3,440,987 | 4/1969 | Coulombe | 112/260 |
| 3,599,585 | 8/1971 | Myrick | 112/260 X |
| 4,765,605 | 8/1988 | Abbott | 271/160 X |
| 4,949,658 | 8/1990 | Kabayashi | 112/322 |
| 5,018,463 | 5/1991 | Nakajima | 112/303 X |

FOREIGN PATENT DOCUMENTS

| | | | |
|---|---|---|---|
| 2593792 | 8/1987 | France | 271/128 |

*Primary Examiner*—Ismael Izaguirre
*Attorney, Agent, or Firm*—McCormick, Paulding & Huber

[57] ABSTRACT

In a sewing device for feeding a sewn product through a given gap defined between the feeding surface of a sewing machine table and forward feeding members provided above the feeding surface, a sewn product supporting member for carrying the sewn product thereon is provided under the feeding members on the feeding side of the sewn product and a vertically driving unit for vertically moving the sewn product supporting member between the height of the feeding surface and that below the same is attached thereto. When the sewn product supporting member is lifted, the front end portion of the sewn product is brought into close contact with the feeding members uniformly and certainly. The feeding members subsequently feed the sewn product toward the feeding surface of the sewing machine table with certainty without rolling in or pulling the front end portion of the sewn product. As a result, it is possible to efficiently fabricate a sewn product of even and high quality.

1 Claim, 3 Drawing Sheets

FEEDING SUPPORT FOR A SEWN PRODUCT

BACKGROUND OF THE INVENTION

1. Field of the Invention

The present invention relates to a feeding support for a cloth to be sewn (referred to as a sewn product hereinafter) in a sewing machine.

2. Prior Art

The applicant proposed a sewing device for continuously fabricating a sewn product of thin cloth folded over several times such as a gauze mask as illustrated in FIG. 9. The sewing device comprising a pair of feeding members 2 provided apart from each other by a given distance above a sewing machine table 1 feeds a sewn product T into a gap S defined by the sewing machine table 1 and the pair of feeding members 2 by moving the same forward and backward to sew the both side portions of the sewn product T with a pair of sewing machines provided on the sewing machine table 1.

In such a sewing device, however, the gap S is unadjustably defined by a feeding surface 4*a* of a guide plate 4 provided on the sewing machine table 1 on which the sewn product T is put and the feeding members 2 of belts wound around belt pulleys 3, causing a technical problem that it is difficult to feed the sewn product T of folded thin cloth through the gap S and an error in sewing is liable to occur. It is to be understood that the elements of the sewing device illustrated in FIG. 9 are shown in profile. Thus, only one of the pair of feeding members 2 and the pair of belt pulleys 3 are shown. The other of the pair of feeding members and belt pulleys are located directly behind the ones shown.

That is, when the sewn product T of folded cloth is fed through the gap S, it is not fed under the pair of feeding members 2 smoothly but is rolled in or pulled by the feeding members 2 at the front edge portions $T_1$ and $T_2$ thereof which are brought into contact with the feeding members 2 as illustrated in FIGS. 10 and 11 so that the folds of the sewn product T are deformed or the front edge portions $T_1$ and $T_2$ thereof are largely folded to be subjected to sewing as they are, causing a defective product. Such a trouble is liable to occur when the gap S is not proper for the thickness t of the sewn product T made of folded cloth.

SUMMARY OF THE INVENTION

The present invention has been made in view of such a technical problem of the prior art. A feeding support for a sewn product of the present invention provided in a sewing device which comprises a sewing machine table 1 and forward feeding members 2 provided above a feeding surface 4*a* of the sewing machine table 1 apart from the feeding surface 4*a* by a given gap S and which sews the sewn product while feeding the same forward through the gap S is characterized in comprising a sewn product supporting member 7 for carrying the sewn product T thereon provided under the feeding members 2 at the feeding side of the sewn product T and a vertically driving unit 13 attached to the sewn product supporting member 7 for vertically moving the same between a height of the feeding surface 4*a* and that lower than the feeding surface 4*a*.

In the operation of the sewing device, the sewn product supporting member 7 has been lowered by the vertically driving unit 13 at the start of sewing operation. At this state, a sewn product T is put on the sewn product supporting member 7, which is lifted to conform to the feeding surface 4*a* at the upper surface thereof by the vertically driving unit 13, when the sewn product T is brought into close contact with the lower surface of the feeding members 2 at least at the portion adjacent to the front end side thereof.

When the sewn product T is clamped with proper pressure between the feeding members 2 and the sewn product supporting member 7 at the portion adjacent to the front end side thereof, the feeding members 2 are moved forward thereby to gradually feed the sewn product T forward. At that time, the sewn product T slides on the upper surface of the sewn product supporting member 7 and feeding surface 4*a*. The sewn product T is gradually fed onto the feeding surface 4*a* from the sewn product supporting member 7 to be sewn.

Upon completion of feeding the sewn product T on the feeding surface 4*a* and sewing the same, the feeding members 2 are stopped and the vertically driving unit 13 lowers the sewn product supporting member 7 to be ready for feeding next sewn product T. Thus the sewn product T is brought into close contact with the lower surface of the feeding members 2 at a wide area adjacent to the front end side thereof from the beginning of 5 feeding, so that it is possible to prevent the front end side of the sewn product T from being deformed by being partially rolled in or pulled by the feeding members 2 when the sewn product T is inserted under the feeding members 2 as the feeding members 2 are driven simultaneously with the completion of lifting the sewn product supporting member 7.

PREFERRED EMBODIMENT OF THE INVENTION

An embodiment of the present invention will be described hereinafter with reference to drawings.

FIGS. 1 to 7 show a feeding support according to a first embodiment of the present invention. In the figures, denoted at 1 is a sewing machine table, on which feeding members 2 each composed of an endless belt moving forward (from left to right in FIG. 2) are provided. The feeding members 2 which are moved by belt pulleys 3 driven to rotate in the direction of an arrow A by way of a driving unit, not shown, defines a given gap S between a guide plate 4 which fixedly covers the sewing machine table 1 except the rear end portion (feeding side) of the feeding members 2 and itself. The gap S which is defined concretely between the lower surfaces 2*a* of the feeding members 2 and a feeding surface 4*a* formed of the upper surface of the guide plate 4 is set as large as to allow the sewn product T to be fed smoothly therethrough under a sewing needle, not shown, while properly clamping the same therein. The sewn product T is, for example, a gauze mask made of thin cloth folded over several times. It is again to be understood, that the elements of the sewing device illustrated in FIGS. 2–7 are shown in profile. Thus, only one of the pair of feeding members 2 and the pair of belt pulleys 3 are shown. The other of the pair of feeding members and belt pulleys are located directly behind the ones shown. This is also the case with respect to a second embodiment of the invention illustrated in FIG. 8.

Figure 1:
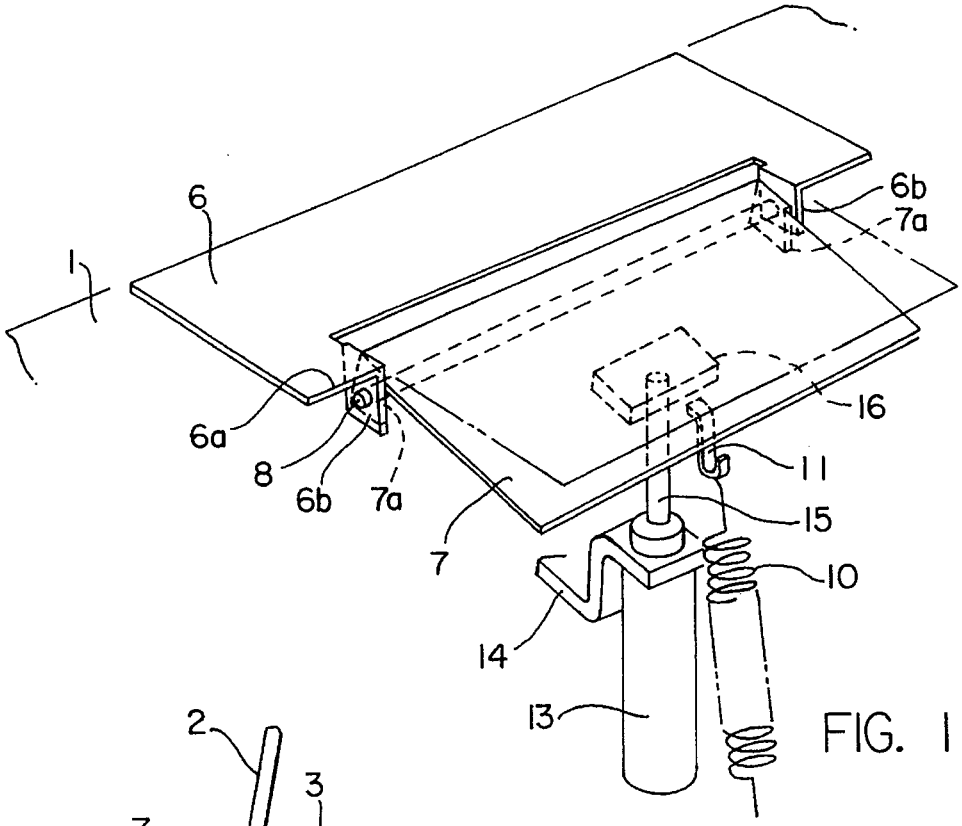
FIG. 1 is a partially omitted perspective view showing a feeding support for a sewn product according to a first embodiment of the present invention.
Figure 2:
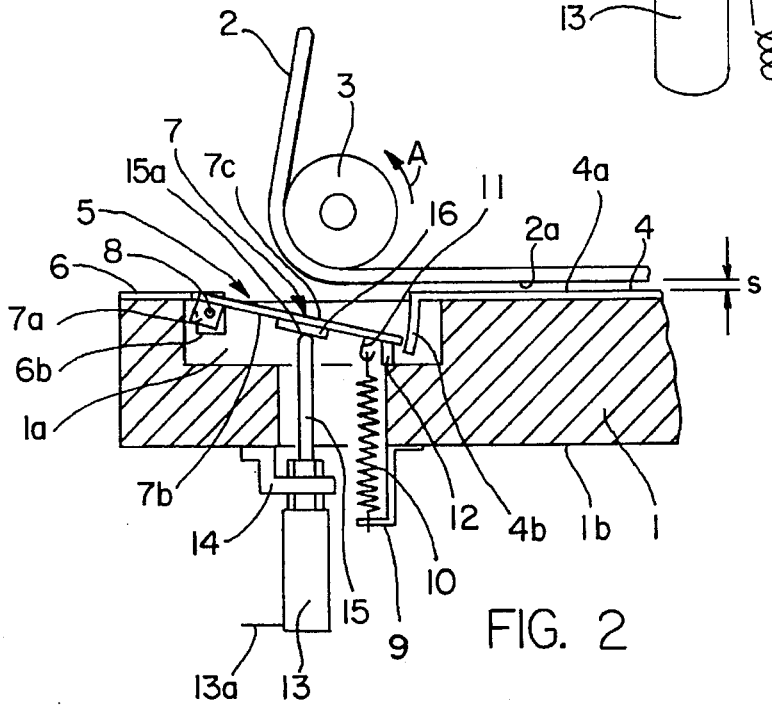
FIG. 2 is a cross-sectional view of the feeding support in FIG. 1.

On the other hand, a cavity la is formed on the sewing machine table 1 at the rear end portion of the feeding members 2 to be adjacent to the rear end portion of the guide plate 4 as illustrated in FIG. 2 and a stopper portion 4*b* which is formed by bending down the rear end portion of the guide plate 4 hang down in the front end portion of the cavity 1*a*. The stopper portion 4*b* has a function to regulate the position to which the sewn product T put on the sewn product supporting member 7, described later, is inserted. The stopper portion 4*b* has a shape of circular arc having a center at a supporting shaft 8, described later.

A flap unit 5 is provided in the cavity 1*a*. The flap unit 5 comprises a plate-shaped flap supporting member 6 fixedly mounted on the upper surface of the rear end portion of the sewing machine table 1 and a plate-shaped sewn product supporting member 7 arranged below the feeding members 2 on the feeding side of the sewn product T, more concretely, under the belt pulleys 3. A pair of bracket portions 6*b* are formed on the left and right sides of the front end portion 6*a* of the flap supporting member 6 and bent portions 7*a* through which the supporting shaft 8 passes are formed on the both sides of the rear end portion of the sewn product supporting member 7, so that the rear end portion of the sewn product supporting member 7 is swingably supported by the supporting shaft 8 extending between the bracket portions 6*b*. A hook member 11 is fixed to the lower surface of the front end portion of the sewn product supporting member 7 and a hook member 9 is fixed to the lower surface 1*b* of the sewing machine table 1 so as to face the hook member 11. The sewn product supporting member 7 is always pulled downward by way of a tension spring 10 stretched between the hook members 9 and 11 so as to be swung downward round the supporting shaft 8 to be in contact with a stopper 12 provided in the cavity 1*a* of the sewing machine table 1 at the front end portion thereof in a normal state.

The sewn product supporting member 7 is equipped with a single-acting pneumatic actuator 13 serving as a vertically driving unit for vertically driving the sewn product supporting member 7 between the height of the feeding surface 4*a* and that below the same. The pneumatic actuator 13 is fixedly mounted on the lower surface 1*b* of the sewing machine table 1 by way of a supporting member 14 and its piston rod 15 is in the cavity 1*a* to face a rubber cushion 16 fixed to the lower surface 7*b* of the sewn product supporting member 7 to the extent that it can be in contact therewith. The rubber cushion 16 has a function to reduce a noise generated when the piston rod 15 collides with the sewn product supporting member 7.

When a compressed air supply route 13*a* supplies compressed air to the pneumatic actuator 13 to operate the same forward, the piston rod 15 is brought into contact with the rubber cushion 16 to swing upward the sewn product supporting member 7 about the supporting shaft 8 until the upper surface 7*c* of the sewn product supporting member 7 conforms to the feeding surface 4*a* of the guide plate 4, and when the pneumatic actuator 13 is exhausted, the sewn product supporting member 7 is swung downward by the resilience of the tension spring 10 to operate the pneumatic actuator 13 backward. The downward swinging of the sewn product supporting member 7 is stopped by the stopper 12 provided in the cavity 1*a* of the sewing machine table 1.

The operation of the feeding support according to the above embodiment will be described with reference to FIGS. 3 to 7. An arrow B indicates the feeding direction of the sewn product T.

Figure 3:
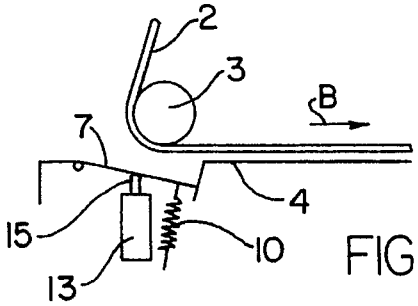
FIG. 3 is a view for explaining the operation of the feeding support in FIG. 1.

Before the start of sewing operation, the belt pulleys 3 and feeding members 2 are at standstill, the sewn product supporting member 7 is swung down by the tension spring 10 and the pneumatic actuator 13 is contracted as illustrated in FIG. 3.

Figure 4:
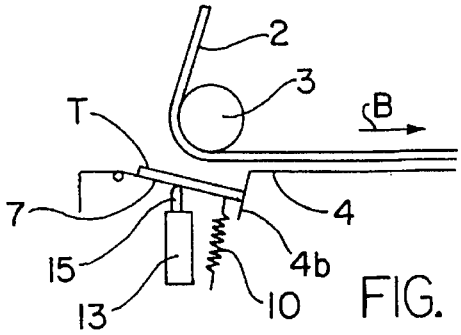
FIG. 4 is a view for explaining the operation of the feeding support in FIG. 1.
Figure 5:
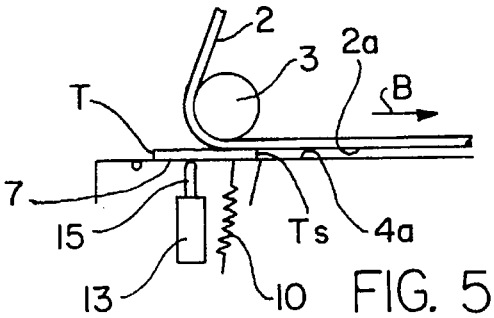
FIG. 5 is a view for explaining the operation of the feeding support in FIG. 1.
Figure 6:
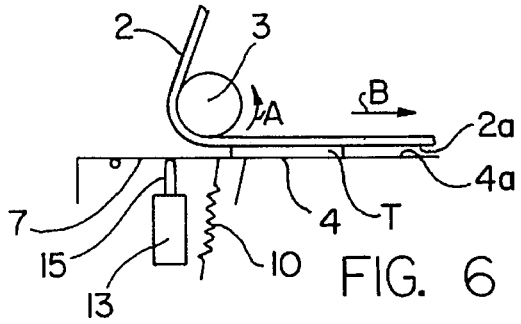
FIG. 6 is a view for explaining the operation of the feeding support in FIG. 1.

At this state, the sewn product T is put on the sewn product supporting member 7 as illustrated in FIG. 4. The sewn product T is inserted to a given position being retained by the stopper portion 4*b*. Thereafter, when the pneumatic actuator 13 is operated forward as illustrated in FIG. 5, the sewn product supporting member 7 is swung upward so that the upper surface 7*c* of the sewn product supporting member 7 conforms to the feeding surface 4*a* of the guide plate 4 and the sewn product T is brought into close contact with the lower surfaces 2*a* of the feeding members 2 at the position adjacent to the front end side TS thereof. When the portion of the sewn product T adjacent to the front end side TS thereof is clamped between the feeding members 2 and sewn product supporting member 7 with a proper pressure, the belt pulleys 3 are driven to rotate in the direction of the arrow A. As a result, the feeding members 2 move forward in the direction of the arrow B thereby to gradually feed the sewn product T forward as illustrated in FIG. 6. At that time, the sewn product T slides on the upper surface of the sewn product supporting member 7 and on the feeding surface 4*a* of the guide plate 4. The sewn product T is gradually fed onto the guide plate 4 from the sewn product supporting member 7 to reach the position of a sewing needle, not shown, to be sewn by the same.

Figure 7:
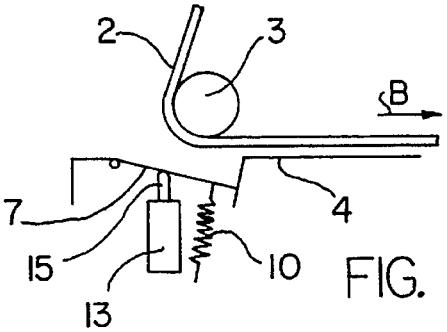
FIG. 7 is a view for explaining the operation of the feeding support in FIG. 1.

Upon the completion of sewing the sewn product T which has been fed from the position on the sewn product supporting member 7, the feeding members 2 are stopped and the pneumatic actuator 13 is operated backward to swing the sewn product supporting member 7 downward as illustrated in FIG. 7. It is desirable that the driving unit of the feeding members 2 is mechanically interlocked with the vertical motion of the sewn product supporting member 7 driven by the pneumatic actuator 13.

As described above, since the sewn product T is put on the sewn product supporting member 7 which has been swung down in the cavity 1*a* of the sewing machine table 1 by way of the backward operation of the pneumatic actuator 13 and the pneumatic actuator 13 is operated forward to lift the sewn product supporting member 7 so that a wide range of the sewn product T adjacent to the front end side TS thereof is brought into close contact with the lower surfaces 2*a* of the feeding members 2 from the start of feeding, it is possible to prevent the front end side TS of the sewn product T from being rolled in or pulled by the feeding members 2 when the sewn product T is inserted under the feeding members 2 if the feeding members 2 are controlled to be driven simultaneously with the completion of lifting the sewn product supporting member 7.

Figure 8:
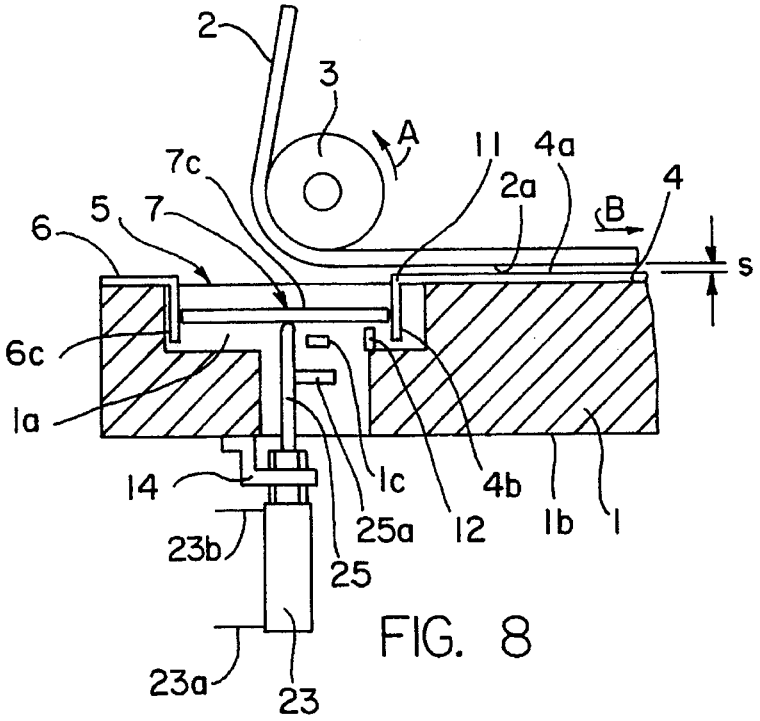
FIG. 8 is a cross-sectional view of a feeding support for a sewn product according to a second embodiment of the present invention.
Figure 9:
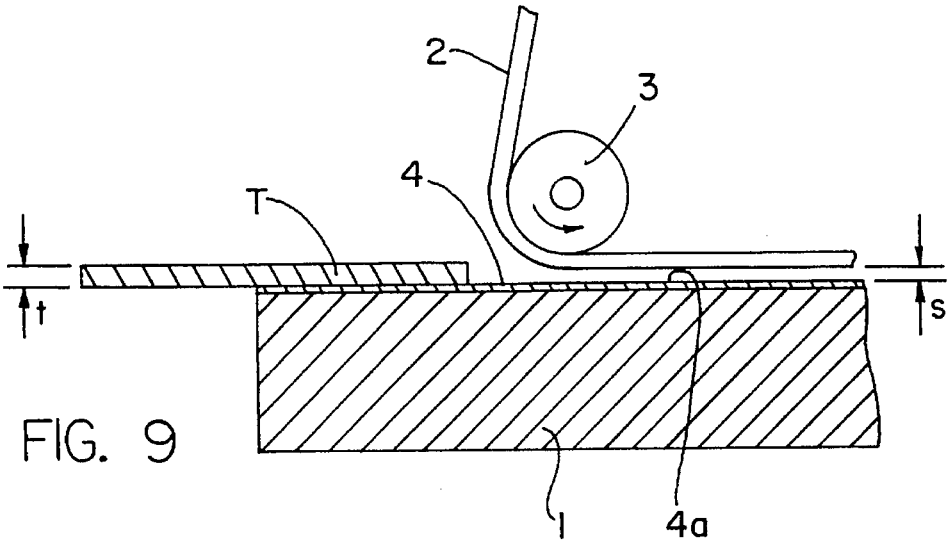
FIG. 9 is a cross-sectional view of a conventional feeding support for a sewn product.
Figure 10:
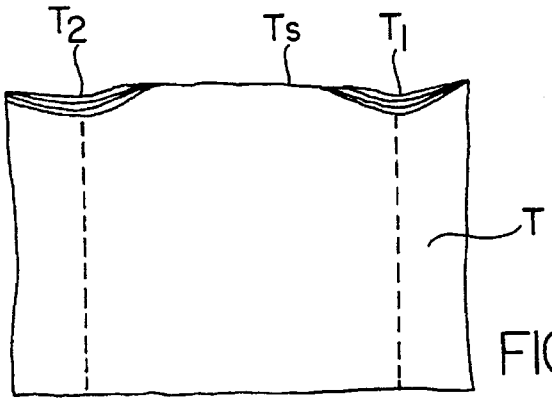
FIG. 10 is a view showing a sewn product.
Figure 11:
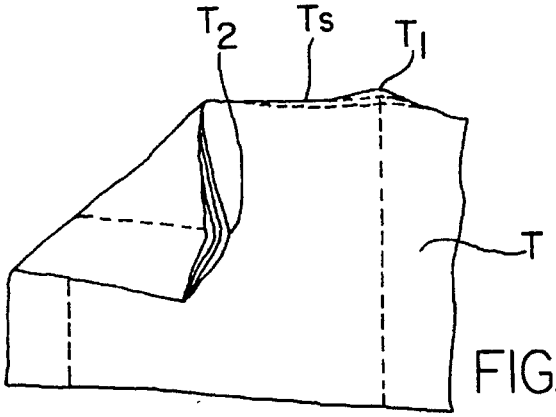
FIG. 11 is a view showing a sewn product.

FIG. 8 shows a feeding support for a sewn product according to a second embodiment of the present invention, wherein substantially same components as those in the first embodiment are denoted at the same numerals and the explanation thereof is omitted. According to the second embodiment, the sewn product supporting member 7 is vertically driven. That is, a pneumatic actuator 23 which is fixedly mounted on the sewing machine table 1 by way of the supporting member 14 is of double-acting type, and the sewn product supporting member 7 is fixed to the upper end of the piston rod 25. A projection 25*a* fixed to the piston rod 25 faces a stopper portion 1*c* formed in the sewing machine table 1 apart therefrom to the extent that the former can be brought into contact with the latter. Moreover, the stopper portion 4*b* of the guide plate 4 extends vertically and the front end portion of the flap supporting member 6 is bent downward to form a guide portion 6*c*.

When a compressed air supply route 23*a* supplies compressed air to the pneumatic actuator 23 to operate the same forward, the sewn product supporting member 7 fixed to the piston rod 25 is driven upward along the stopper portion 4*b* and guide portion 6*c* until the projection 25*a* fixed to the piston rod 25 is brought into contact with the stopper portion 1*c* formed in the sewing machine table 1 so that the upper surface 7*c* of the sewn product supporting member 7 conforms to the feeding surface 4*a* of the guide plate 4. When an upper compressed air supply route 23*b* supplies compressed air to the pneumatic actuator 23 to operate the same backward, the sewn product supporting member 7 fixed to the piston rod 25 is driven downward until it is stopped by the stopper 12.

Accordingly, the sewn product T can be put on the sewn product supporting member 7 which is swung downward so that it can be easily inserted under the feeding members 2 to be retained at a given position by the stopper portion 4*b*. Thereafter the sewn product supporting member 7 is driven upward to clamp the portion of the sewn product T adjacent to the front end side TS of the same between the feeding members 2 and itself with a proper pressure. Then the belt pulleys 3 are driven to rotate in the direction of the arrow A to move the feeding members 2 in the direction of the arrow B thereby to feed the sewn product T forward gradually. In this way, an almost similar effect to the first embodiment can be obtained with regard to feeding the sewn product T also in the second embodiment.

As understood from the above description, according to the present invention, it is enough for an operator to put a sewn product on a sewn product supporting member which is swung down and drive a vertically driving unit in order to lift the sewn product supporting member which overlaps feeding members over a sufficient area so as to bring at least the front end portion of the sewn product into contact with the feeding members uniformly and certainly, so that subsequently the feeding members can feed the sewn product to the feeding surface of the sewing machine table with certainty. As a result, it is possible to efficiently fabricate a sewn product of even and high quality free from defects caused by the rolled or pulled front end portion thereof.

What is claimed is:

1. A feeding support for a sewn product provided in a sewing device of the type comprising a sewing machine table having a feeding surface and a feeding end, and feeding members positioned above the feeding surface and spaced therefrom by a given gap, wherein the sewn product is sewn by the sewing device as the sewn product is advanced along the table by the feeding members from the feeding end of the table through the gap past a sewing station, said feeding support comprising:

a sewn product supporting member positioned under the feeding members at the feeding end of the table for carrying the sewn product thereon; and a vertically driving unit attached to said sewn product supporting member for vertically moving the supporting member between a first position located below the height of the feeding surface and a second position located at the height of the feeding surface, said supporting member partially overlapping the feeding members and being spaced therefrom by the given gap when the supporting member is in its second position.

* * * * *

UNITED STATES PATENT AND TRADEMARK OFFICE

CERTIFICATE OF CORRECTION

PATENT NO. : 5,596,942

DATED : January 28, 1997

INVENTOR(S) : Kojima et al.

It is certified that error appears in the above-indentified patent and that said Letters Patent is hereby corrected as shown below:

TITLE PAGE

Assignee:

Please delete "Netherlands: and substitute --Netherlands Antilles--.

Signed and Sealed this

Fifteenth Day of April, 1997

Bruce Lehman

*Attest:*

BRUCE LEHMAN

*Attesting Officer*

*Commissioner of Patents and Trademarks*